United States Patent [19]

Boshoven

[11] 4,379,548

[45] Apr. 12, 1983

[54] EXHAUST SYSTEM ESPECIALLY FOR USE IN THE CAST HOUSE OF A BLAST FURNACE

[75] Inventor: Billy Boshoven, Heerhugowaard, Netherlands

[73] Assignee: Estel Hoogovens BV., IJmuiden, Netherlands

[21] Appl. No.: 241,253

[22] Filed: Mar. 6, 1981

[30] Foreign Application Priority Data

Mar. 7, 1980 [NL] Netherlands ..... 8001371

[51] Int. Cl.[3] ..... C21B 7/22; C21C 5/38

[52] U.S. Cl. ..... 266/158; 98/115 R; 266/197

[58] Field of Search ..... 266/158, 197; 98/115 R, 98/115 VM, 115 LH, 115 B; 285/272, 45, 122; 55/428, 429, 432; 308/187.1, 36.1

[56] References Cited

U.S. PATENT DOCUMENTS 1,038,396 9/1912 Langford ..... 285/272

1,080,193 12/1913 Bohan ..... 98/115 R 2,449,592 4/1947 Daddario ..... 19/146

OTHER PUBLICATIONS

Nicola, A. G., "Blast Furnace Cast House Emission Control", *Iron and Steel Engineer,* Aug. 1979, pp. 33–39.

*Primary Examiner*—L. Dewayne Rutledge
*Assistant Examiner*—Christopher W. Brody
*Attorney, Agent, or Firm*—Jon M. Lewis

[57] ABSTRACT

In a cast house of a blast furnace, one or more movable exhaust hoods, connected to exhaust ducts, are provided for extraction of gas and dust. In order to provide such a hood which is easily moved manually by the operating personnel but which, with its duct, nevertheless does not unduly obstruct the working space, the hood is carried by a swivellable duct section which is connected to a fixed duct section at its swivelling axis and is supported, in cantilever fashion, by a bearing, e.g. a ball bearing, which is located outside the duct and extends circumferentially around the duct.

13 Claims, 3 Drawing Figures

EXHAUST SYSTEM ESPECIALLY FOR USE IN THE CAST HOUSE OF A BLAST FURNACE

BACKGROUND OF THE INVENTION

1. Field of the Invention

The present invention relates to exhaust apparatus, especially such apparatus for use in the cast house of a blast furnace, the apparatus including at least one movable exhaust hood and ducting connected thereto. The invention also relates to a cast house having such apparatus.

2. Description of the Prior Art

Considerable dust nuisance is generated when a blast furnace is tapped. This dust consists mainly of finely divided iron oxide, of which about 70% has a particle size of less than 0.01 mm. More than half the dust formed originates from the point at which the blast furnace is tapped, the rest of the dust coming in approximately equal amounts from the point at which the iron and slag are separated and the point at which the iron is tipped into a transfer ladle or other means of transport.

This dust problem is generally tackled by placing exhaust hoods above the critical points mentioned above. To be efficient, such exhaust hoods have to be of considerable size, and the exhaust ducts connected to them must also be generously dimensioned. As a result, the exhaust apparatus is a considerable hindrance to the personnel operating the blast furnace and the runner system. Various proposals have been made for reducing this hindrance to a minimum. It should, however, be borne in mind that in most existing blast furnaces the space around the furnace is limited and, moreover, that this area has to be kept reasonably clear for work involving clay guns, taphole drills and various transport systems.

For these reasons the idea of making the exhaust hood and the adjoining section of the exhaust duct mobile has already been put forward. Possible ways of achieving this movement are (i) lifting the hood with a crane and moving it, (ii) shortening or lengthening the first part of the exhaust duct telescopically, and (iii) swivelling the duct and the hood. Swivelling arrangements are known in which the considerable weight of the exhaust hood and duct is taken by a crane track or a swivelling crane of fork design which grips the hood or by a heavy pillar running through the cast house which can also act as the exhaust duct. All these proposals for swivelling arrangements, have the distinct disadvantages that they still take up a lot of room, are expensive and above all are difficult to swivel.

SUMMARY OF THE INVENTION

The first object of the present invention is therefore to provide exhaust apparatus which takes up less space and also requires a minimum of crane structures or pillars in the cast house. A further object of the invention is to provide exhaust apparatus in which the exhaust hood is so easy to swivel that it can be moved to and from its operating point by the operating personnel without the expenditure of considerable energy.

The invention as claimed is intended to meet these requirements. Essentially the invention proposes that the exhaust hood and swivelling duct section are supported in cantilever fashion by a low friction bearing, e.g. a ring bearing, located at the axis of swivelling, which is the location where the swivelling duct section connects to the fixed duct section. The bearing is for instance a rolling bearing and extends circumferentially around and outside the duct. The advantages are (i) that no other bearing or support structure need be used, between the swivelling axis and the hood, so that obstruction of the working area is minimized and (ii) that because a large low friction bearing is used at the swivelling axis the force which has to be applied to the hood to move it is very low. In fact it is found that the hood can easily be moved manually, which achieves great convenience for the operating personnel and avoids the expense of any crane system and associated control means for moving the hood. Of course the bearing used in the present invention must itself be of special stout construction since the loads on it may be high, but the expense of providing such a bearing are outweighed by savings in cost elsewhere and particularly by the convenience of operation.

Preferably the bearing is itself supported by the fixed duct section, which can provide an especially compact construction.

Although the fixed section of the exhaust duct can extend vertically upwards out of the cast house, the greatest saving in space is achieved if it runs vertically downwards through the floor.

It is possible in the invention to achieve a further saving in space by having at least two independently movable hoods and swivelling duct sections, each supported as described above. The two ducts are then connected to a common outlet duct, for instance with valves being employed for control of the exhaust capacities of the different hoods. The two swivelling axes may be located close to each other, making the support arrangement highly compact.

BRIEF INTRODUCTION OF THE DRAWINGS

An embodiment of the invention will now be described by way of non-limitative example with reference to the accompanying drawings, in which:

FIG. 1 is a side view of an exhaust apparatus for a cast house of a blast furnace, embodying the invention, FIG. 2 is a plan view of the apparatus of FIG. 1, and FIG. 3 is a vertical axial section through a bearing structure of the apparatus of FIG. 1.

DESCRIPTION OF THE PREFERRED EMBODIMENT

Figure 1:
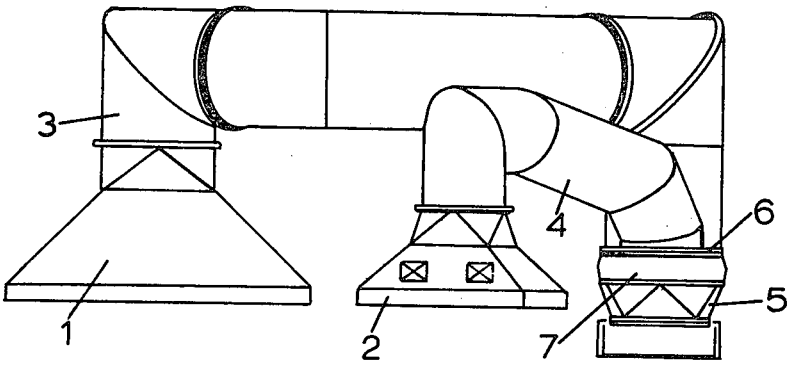
Figure 2:
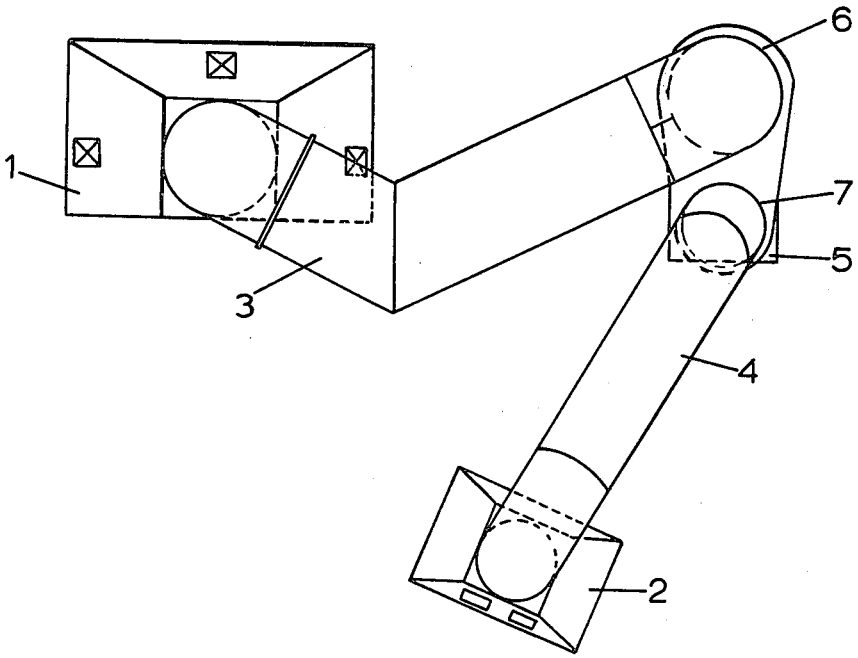
Figure 3:
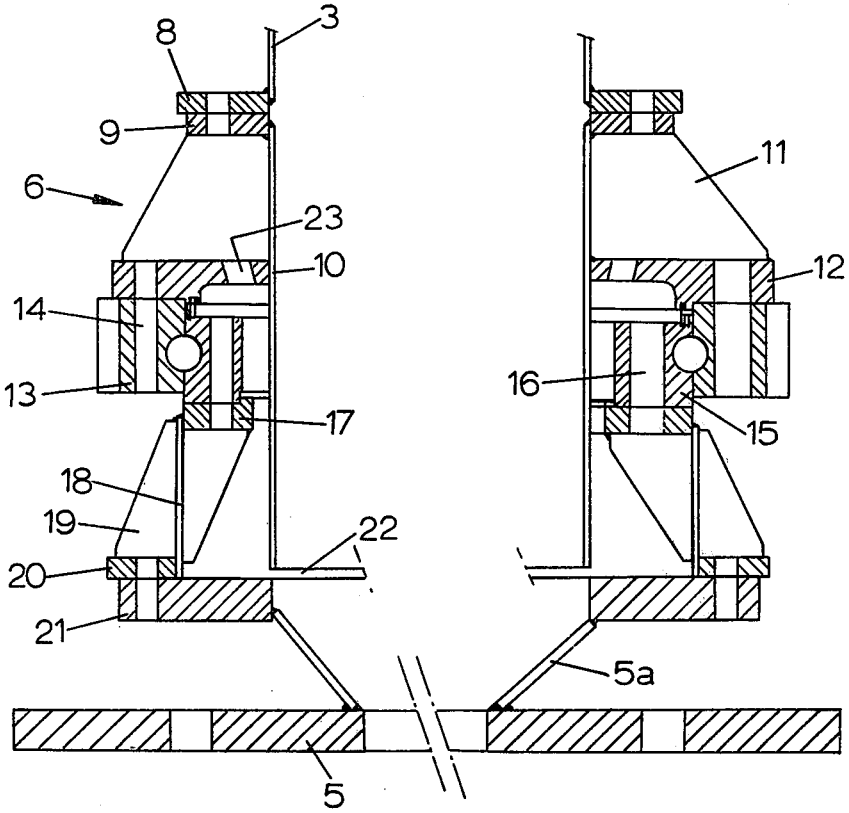

FIGS. 1 to 3 show an exhaust apparatus installed in the cast house of a blast furnace. No details of the cast house are shown. The exhaust apparatus has two independently movable exhaust hoods 1,2 which open downwardly. The larger hood 1 is intended to be positioned above the tapping point of the blast furnace, while the smaller hood 2 is capable of being positioned above the skimmer of the runner system. The hoods 1,2 are independently supported by two swivellable duct sections 3,4 which connect the interiors of the hoods to fixed duct sections at the joints 6,7. The two fixed duct sections are connected by a common linking duct 5 to an outlet duct which, in use, is connected to a source of suction so that gas and dust is extracted from the hoods. As mentioned above, valves (not shown) may be provided to control the gas flow in the two duct sections 3,4.

FIGS. 1 and 2 illustrate how the hoods 1,2 and swivellable duct sections 3,4 are in each case supported entirely in cantilever fashion at the joints 6,7 there being otherwise no other supports. FIG. 3 shows this bearing system at the joint 6 in detail, for the duct section 3, but the bearing for the duct section 4 at the joint 5 can be taken as similar. Both duct sections 3,4 are swivellable about vertical axes.

The duct section 3 is connected at the joint 6 end to a short tapering fixed duct section 5*a* which itself opens into the linking duct 5. The fixed duct section 5*a* also supports the bearing (to be described) which carries the duct section 3 and the hood 1. The duct sections 3 and 5*a* are coaxial at the joint 6, this axis coinciding with the axis of swivelling.

The swivelling duct section 3 ends in a cylindrical extension piece 10 which is mounted by welded-on flanges 8,9 having holes for bolts (not shown). The extension piece 10 is carried on the bearing by a main flange 12 which is connected by radial reinforcing webs 11 to the flange 9. The main flange 12 is mounted, by bolts (not shown) in bolt holes 14, on the outer ring 13 of a ring bearing 13,15, the inner ring 15 of which is mounted (by bolts—not shown—in bolts holes 16) on a flange 17 which itself is carried, through radial webs 19 and a cylindrical piece 18 on a flange 20. The flange 20 is bolted to a large flange 21 welded onto the fixed duct section 5*a*.

The ring bearing 13,15 which is of sturdy construction, is a ball bearing, the ball races of which are arranged so that the bearing balls withstand the vertical loads imposed by the cantilever support arrangement of the duct section 3 and hood 1. Thus, the opposed faces of the rings 13,15 are generally parallel to the swivelling axis, though the balls run in grooves. The bearing 13,15 is entirely outside the duct piece 10 and is in fact separated from it by a gap (see below). The bearing 13,15 extends circumferentially for 360° around the duct and is therefore of large diameter. This large diameter, together with the use of a low friction ball bearing, means that the hood 1 can easily be moved around the swivelling axis by manual pushing. The invention is not restricted to the use of ball bearings, or even rolling bearings. Other low friction bearing systems may be used.

Providing a fully airtight joint between the swivelling and the fixed sections of the exhaust duct can lead to exceptional technical complications. Leakage at this point is objectionable in that air containing dust is drawn from the cast house atmosphere through the bearing and may seriously contaminate it, thereby impairing the swivelling capacity of the installation.

There is a gap 22 between the lower end of the duct piece 10 and the flange 21 of the fixed section 5*a*. This gap communicates with the outside atmosphere by way of the space within the cylinder piece 18, the space inside the ring 15 and passages 23 through the flange 12. This prevents any air leaking at the joint of the two duct sections from coming into contact with the balls or the ball races. The air goes past, and not through, the bearing.

What is claimed is:

1. In an exhaust apparatus, especially for use in the cast house of a blast furnace, comprising at least one movable exhaust hood which is connected by a duct to a suction source for extraction of gas from the hood, said duct having a fixed duct section and a swivelling duct section swivellable about an axis and connecting the hood to the fixed duct section, the hood being carried by the swivelling duct section, the improvement that:

said fixed duct section and said swivelling duct section each have a portion extending generally coaxially with said axis of swivelling of the swivelling duct section, which portions are connected together, and that said swivelling duct section is supported so as to extend in cantilever fashion substantially freely to said hood, by low friction bearing means located outside the duct and extending circumferentially around the duct, and said bearing means is supported by said portion of the fixed duct section which thereby carries the swivelling duct section and the hood.

2. In an exhaust apparatus, especially for use in the cast house of a blast furnace, comprising at least one movable exhaust hood which is connected by a duct to a suction source for extraction of gas from the hood, said duct having a fixed duct section and a swivelling duct section swivellable about an axis and connecting the hood to the fixed duct section, the hood being carried by the swivelling duct section, the improvement that:

said fixed duct section and said swivelling duct section each have a portion extending coaxially with said axis of swivelling of the swivelling duct section, which portions are connected together, and that said swivelling duct section is supported at said axis, so as to extend in cantilever fashion substantially freely to said hood, by low friction bearing means located outside the duct and extending circumferentially around the duct, and there is a gap between the said connecting portions of the fixed and swivelling duct sections, said gap being in communication with the outside atmosphere via a passageway which lies between the bearing means and the exterior wall of the duct.

3. Exhaust apparatus according to claim 2 wherein the said connecting portion of the swivelling duct section projects axially through the bearing means which extends circumferentially around it.

4. Exhaust apparatus according to claim 1 wherein said bearing means is a bearing having rolling elements located between bearing faces.

5. Exhaust apparatus according to claim 4 wherein said bearing faces are parallel to said axis of swivelling.

6. Exhaust apparatus according to any one of claims 1 and 3 wherein at least two independently movable hoods are provided, each being supported by a said duct comprising a fixed duct section and a swivellable duct section, the two ducts being connected to a common exhaust outlet.

7. Exhaust apparatus according to any one of claims 1 and 3 which is mounted in the cast house of a blast furnace, wherein the fixed duct extends through the floor of the cast house.

8. A cast house of a blast furnace having an exhaust apparatus according to any one of claims 1 and 3.

9. Exhaust apparatus for the cast house of a blast furnace, comprising (a) at least one movable exhaust hood opening downwardly for extraction of gas and dust from the cast house, (b) a fixed exhaust outlet duct to which, in use, suction is applied to extract gas from the hood, (c) a duct section having a first end connected to and carrying said exhaust hood and a second end connected to said fixed outlet duct, said duct section being swivellable about a vertical axis so as to move said exhaust hood and said second end thereof being coaxial with said vertical axis, (d) low friction bearing means coaxial with said vertical axis supporting said duct section and said hood carried thereby in cantilever fashion, said bearing means, as seen in plan view, being located outside, and extending circumferentially around, said second end of said duct section.

10. Exhaust apparatus according to claim 9 wherein said bearing means is carried by said fixed duct.

11. Exhaust apparatus according to claim 2 wherein at least two independently movable hoods are provided, each being supported by a said duct comprising a fixed duct section and a swivellable duct section, the two ducts being connected to a common exhaust outlet.

12. Exhaust apparatus according to claim 2 which is mounted in the cast house of a blast furnace, wherein the fixed duct extends through the floor of the cast house.

13. A cast house of a blast furnace having an exhaust apparatus according to claim 2.

* * * * *